US011058243B2

(12) United States Patent
Gräber

(10) Patent No.: US 11,058,243 B2
(45) Date of Patent: Jul. 13, 2021

(54) SLEEVE FOR HOLDING AND CARRYING CUPS AND CONTAINERS HAVING HOT OR COLD CONTENTS

(71) Applicant: SLEEVEMATIX GMBH, Berlin (DE)

(72) Inventor: Marco Gräber, Berlin (DE)

(73) Assignee: sleevermatix GmbH, Marco Gräber, Berlin (DE)

( * ) Notice: Subject to any disclaimer, the term of this patent is extended or adjusted under 35 U.S.C. 154(b) by 58 days.

(21) Appl. No.: 15/770,242

(22) PCT Filed: Oct. 27, 2016

(86) PCT No.: PCT/DE2016/100503

§ 371 (c)(1),
(2) Date: Jul. 20, 2018

(87) PCT Pub. No.: WO2017/071689

PCT Pub. Date: May 4, 2017

(65) Prior Publication Data

US 2019/0008300 A1 Jan. 10, 2019

(30) Foreign Application Priority Data

Oct. 30, 2015 (DE) ..... 10 2015 118 579.2

(51) Int. Cl.
*A47G 23/02* (2006.01)
*B65D 25/28* (2006.01)
*B65D 81/38* (2006.01)

(52) U.S. Cl.
CPC ..... *A47G 23/0216* (2013.01); *B65D 25/2814* (2013.01); *B65D 81/3876* (2013.01); *B65D 81/3886* (2013.01)

(58) Field of Classification Search
CPC ..... A47G 23/0216; B65D 25/2814; B65D 81/3876; B65D 81/3886
USPC ..... 220/739
See application file for complete search history.

(56) References Cited

U.S. PATENT DOCUMENTS 3,473,682 A * 10/1969 Studen ..... A47G 23/0216 215/12.1
4,194,627 A * 3/1980 Christensen ..... B65D 25/34 206/545
5,205,473 A 4/1993 Coffin, Sr.
5,359,809 A * 11/1994 Johnson ..... A01G 23/04 220/4.24

(Continued)

FOREIGN PATENT DOCUMENTS

DE 20310442 U1 1/2004
DE 202007000854 U1 4/2007

(Continued)

*Primary Examiner* — J. Gregory Pickett
*Assistant Examiner* — Niki M Eloshway

(57) ABSTRACT

The invention relates to a cover which is also known under the name "sleeve" and serves for picking up and insulating thin-walled cups and containers. This sleeve prevents the user from burning his fingers when hot drinks such as coffee, tea or hot broth, bouillon, are introduced into the thin-walled cup and that the warm hands of the user heat a cold drink that was filled into the cup. Furthermore, by the materials used it supports the cleaning and through the attached joints a space-saving transportation is possible. The construction and the materials used allow for a long-term reuse.

19 Claims, 7 Drawing Sheets

(56) References Cited

U.S. PATENT DOCUMENTS 5,826,786 A 10/1998 Dickert
6,273,333 B1 8/2001 Ward
6,814,253 B2 11/2004 Wong
7,080,753 B1 * 7/2006 Miller ..... A47G 23/0216 220/666
7,922,031 B1 4/2011 Prince
8,061,551 B2 * 11/2011 Matlovich ..... B65D 25/34 220/737
8,752,726 B2 6/2014 Molz
2001/0019056 A1 * 9/2001 Rosenfeldt ..... B65D 9/38 220/7
2005/0153113 A1 * 7/2005 Hseih ..... B41M 7/0009 428/201
2006/0043097 A1 * 3/2006 Tulp ..... A47G 23/0216 220/737
2006/0179699 A1 * 8/2006 Gemmell ..... G06Q 99/00 40/661
2007/0138188 A1 * 6/2007 Mace ..... B31D 5/0086 220/739
2008/0315451 A1 * 12/2008 Urquhart ..... B65D 81/3876 264/132
2010/0263235 A1 * 10/2010 Schaefer ..... A43B 7/12 36/109
2011/0192859 A1 * 8/2011 Belford ..... B65D 81/3876 220/739
2012/0285973 A1 * 11/2012 Hargett ..... A47G 23/0216 220/592.24
2013/0213986 A1 * 8/2013 Couvelier ..... B65D 81/3876 220/737
2016/0135629 A1 * 5/2016 Robertson ..... A47G 23/0216 220/739
2016/0286994 A1 * 10/2016 Felty ..... A47G 23/0216

FOREIGN PATENT DOCUMENTS

DE 202008004067 U1 7/2008
DE 202012103809 U1 1/2013
DE 202013103545 U1 12/2013

* cited by examiner

SLEEVE FOR HOLDING AND CARRYING CUPS AND CONTAINERS HAVING HOT OR COLD CONTENTS

BACKGROUND

Technical Field

The invention relates to a cover which is also known under the name "sleeve" and serves for picking up and insulating thin-walled cups and containers.

This sleeve prevents the user from burning his fingers when hot drinks such as coffee, tea or hot broth, bouillon, are introduced into the thin-walled cup and that the warm hands of the user heat a cold drink that was filled into the cup. In reverse conclusion the sleeve also prevents that the user undercools his or her fingers and that the hands of the user cool down the beverage. Conversely, the sleeve also prevents the user undercools his fingers and that the user's hands cool the drink. In addition, the cooling and heating of the contents to the surrounding temperature is slowed down.

Background Description

The known cup sleeves are made from a cut-out of corrugated paper and corrugated cardboard, that can be transformed into a conical collar or is already formed. The corrugation of these sleeves is largely vertical. These known covers feel soft, and they do not hold the cup reliably because the cup is immersed more or less deeply into the collar-shaped cover. Some cup sleeves of this kind must be opened or folded respectively before insertion. Other cup sleeves are dimensionally stable and have a laterally projecting handle.

Furthermore, it is known that different designs for cup holders made of different materials and cut-outs have been developed.

Most variants have been developed in the USA and patented and partially used there.

Most patents consist of more or less elaborate constructions, many of which are made of solid materials such as plastic, which justify a mass use neither from a cost nor an ecological perspective. Others have to be folded, consolidated, fixed or interlinked before the cup can be inserted into the holder.

Other patents are very well suitable for mass deployment with disposable cups, as U.S. Pat. No. 5,205,473, which consists of bonded conically tailored corrugated cardboard. The cup is inserted into the conical pre-cut shape. The channels of the corrugated cardboard allow insulation from heat or cold. However, the patented cup holder only allows the grip around the sleeve. Holding multiple cups in one hand is therefore not always ensured. Besides the danger of being burned when the cup overflows continue to exist. Also, with cups made of light material like for example plastic cups the cup sleeve and the pressure applied on the cup walls when grasping the cup with the hand can lead to an overflow. Furthermore, the cup sleeve does not automatically adapt to other, non-conical cup shapes.

The U.S. Pat. No. 6,273,333 describes a flat pre-cut shape made of solid board, corrugated board or other materials which are assembled and form a cup sleeve. This design is suited for mass use with disposable cups due to its material cost. Though the usage with only one hand is cumbersome, partially aiding with the second hand is needed based on the design of some models.

Furthermore, the US Pat. No. 2004/0070222 is known, whereby in this design of the development a casing composed of cellular material and thick, translucent, which was prefabricated conically, exists, wherein the cup will be placed.

In addition various protective holders and overlay covers for disposable cups are known, like for example in utility patent no. DE 20 2008 004 067, utility patent no. DE 20 2007 000 854, utility patent no. DE 20 2012 103 809, utility patent no. DE 203 10 442 as well as utility patent DE 20 2013 103 545. These patents each exhibit different solutions, which serve to hold and carry disposable cups and containers. It is in all cases a disposable item that can only be used for one-time use. In some patents the rigidity in regard to the transport of hot beverages is not given.

BRIEF SUMMARY OF THE PRESENT TECHNOLOGY

The aim of the invention is to find a sleeve for holding and supporting of cups and containers with hot or cold contents, wherein

- the sleeve may be used in continuous or repeated use as a heat and cold protection,
- a very rigid structure exists,
- the design automatically adapts to various cup shapes,
- with one variant the most common sizes for dispensing and vending cups and drinks are covered for hot and cold drinks,
- the user is protected from extreme heat or cold effect and moisture, such as condensation,
- a secure hold is granted without unwanted opening or tearing,
- a secure holding of the sleeve with the cup with one hand is granted,
- when not in use an immediate folding takes place and allows for a reuse,
- can be used as a coaster or lid,
- in addition, for commercial use both sides can be printed upon and
- the product is one hundred percent recyclable.

None of the above mentioned or further existing utility patents or patents respectively allow all these characteristics simultaneously.

The objective of the invention is to realize a cover for holding and carrying of cups and containers with hot or cold content, where in particular a very stable support for different sizes and shapes is developed and simultaneously repeated and permanent use of the cover can take place.

The invention is fulfilled in regard to its objectives that a cover to hold and carry cups and containers with hot or cold contents is realized based on patent claim 1.

The cover is designed in such a way

- that the conical sleeve is connected with hinges on the right and left lateral edges of the sleeve or the unfolded sleeve, whereby through pressure on the lateral edges of the sleeve a placing on a cup or container from the bottom can be realized and the sleeve is consisting of heat and cold protective material and at the same time an insulation of the cup or container contents takes place, by what a decreasing in temperature and/or an increasing in temperature for cold drinks is slowed down,
- that the sleeve and the unfolded sleeve and the parts of the sleeve connected by hinges and this hinge is securely locked in by rivets or eyelets and holes for rivets and eyelets, that for the rivets and eyelets different shapes of rivets and eyelets and different rivet and eyelet variants can be chosen, that the sleeve and the unfolded sleeve and the sleeve parts can be made of different layers of material. Through the different layers/sandwich of material a tension is induced, which automatically collapses the sleeve, that the hinges are fixated on the left and right lateral edges with rivets and are inserted into a cavity in the surfaces in the unfolded sleeve and the sleeve parts on the side, That the individual material layers are bonded together on the entire surface with one another and thereby bonding is edge accurately and uniformly realized by adhesive films.

The sleeve is environmentally friendly on two levels. First, resources are spared due to its reusability and less waste is caused, and secondly by the materials used, the sleeve is recyclable and possibly also biologically degradable. Currently either two cups are often used or in addition napkins, or a cardboard cover. Otherwise, the cup is carried in a way that no contact with the heated areas occurs. This is not particularly user-friendly.

Through the materials used and the constitution of the surface, the sleeve, should staining take place, can be easily cleaned. The sleeve can also receive a coating which will repel water and grease even more. This would also help in the areas of the engravings. In order to accomplish this a poly-epoxy resin is considered.

Furthermore, the sleeve is easy to transport. For this, the cover is divided into two equal areas that are connected by hinges. The hinges can be opened at any angle and therefore be flexibly adapted to the size of a cup. The outer surfaces are made of flexible, elastic material and thus can also adapt precisely to the shape of the container. The stiffness, yet flexibility of the material causes the shell, unless it is used for transporting a beverage cup, to go back to a flat state. This way the sleeve can be transported in pockets of pants, shirt or in handbags etc. in a space saving manner. Since the joints allow the folding of the sleeve and therefore the sleeve does not have to be folded in its outer faces, no tear occurs on the material.

Additionally it is given that the bendability of the outer faces of the sleeve can be reached without deficits to the structural integrity of the used cork layer only, because the cork can be compressed to a certain percentage.

Thereby the cork will be compressed inwardly when being bend and does not curl. This would not be possible with another, conventional, non-compressible material in combination with several layers. Furthermore, the slippage and the movement of the inner layer is prevented by the adhesive tapes, when being bend, due to the strength of the adhesion being too great.

The materials for the sleeve have been chosen in a way that through the combination of multiple layers and the selection of materials with a low heat conductivity it delivers a better heat protection than conventional transportation gadgets (mostly made of cardboard).

Through the improved insulation, the use of cups made of less material should be possible in the long term. This will not solve the waste problem completely but cause a significant reduction. Mugs are currently made from paper or cardboard, which have a very low thermal conductivity rating. Since only the core benefit, the transportation of the liquid is necessary, it can be taken away from the insulating function. This results in significant material savings. Considering reusable cup of polymers, usually polyethylene, as this material has a higher thermal conductivity rating than cardboard or paper and is therefore also in need of additional insulation.

Further, the materials were chosen so that they permit an increased degree of personalization. In the outer surfaces designs may be engraved or cut. Also incorporating photographs is possible. The outer faces may take various colors and textures. Due to the fact that the sleeve consists of two separate faces, these may have different colors and different base materials. Also, a different pattern on both sides is possible. By the potential processing with a laser cutter, the basic shape of the sleeve can be adjusted quickly. For holding the beverage cup, only the side edges on which the hinges are attached, and their angles are fundamentally important. This means that the round edges may take other forms without experiencing a loss of functionality.

Essential to the invention is still the problem of positioning the hinges in the individual sleeve part unfolded and the sleeve parts for the cups of the sleeve. In this case, cut-outs are given for the hinges in the side edges where the hinges are used and are firmly locked in over rivets or sleeve variants. Hereby the hinges are embedded in an intermediate layer, which is given as a cut-out.

Hereinafter, the embodiment of the solution according to the invention of a cover for holding and carrying of cups and containers with hot or cold contents will be described.

DETAILED DESCRIPTION OF THE PRESENT TECHNOLOGY

Figure 1:
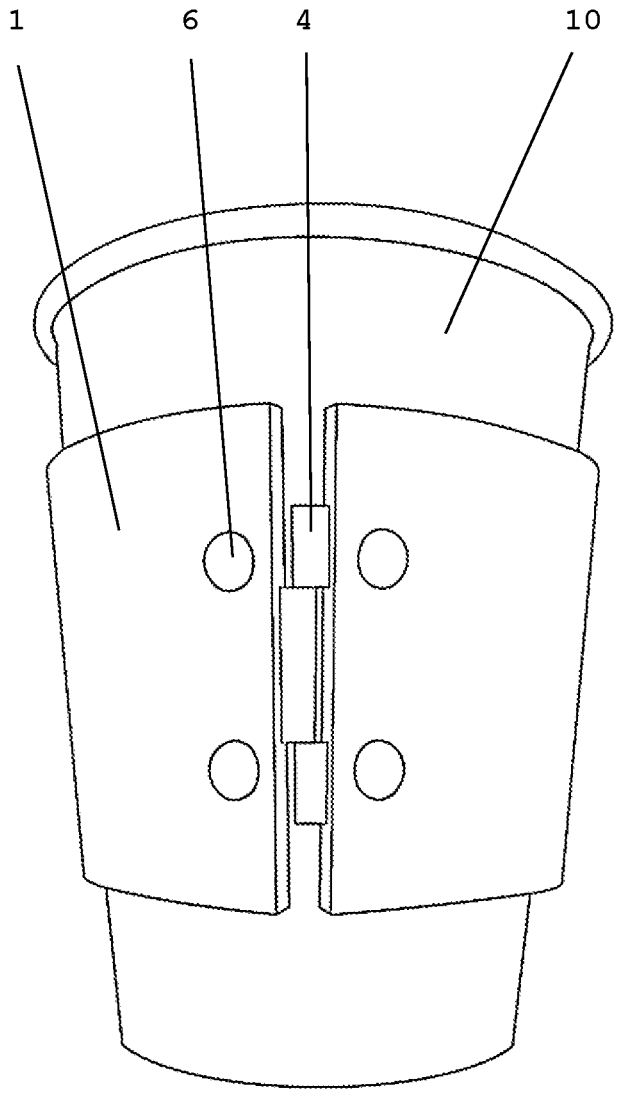
FIG. 1 is a perspective view of a sleeve on a cup.

Hereby the FIGS. 1 to 5 show the arrangement of the sleeve unfolded, lateral view, hinge position, riveting position and the inner layer of a sleeve with cut-outs for the placement of the hinges. When assembling the layered materials, the following layer configurations from the outside inwards result for sleeve 1.

a. Bonded leather (1 mm)-adhesive-cork (1 mm)-adhesive-leather fiber (1 mm)=a total of about 3 mm, since the bonding agent is negligible in its thickness.

b. PU leather (0.2 mm)-adhesive-bonded leather (1 mm)-adhesive-cork (1 mm)-adhesive-bonded leather (0.8 mm)=a total of about 3 mm, since the bonding agent is negligible in its thickness.

Hereby however, significantly different compositions of the individual layer configurations are also conceivable, in particular through the use of polyurethane foam, cork, PE foam, PU leather, bonded leather, leather, synthetic leather, etc.

For example, the following possibilities are given:

PU leather-adhesive-bonded leather-adhesive-PU foam-adhesive-PU leather; also, varnish can be used in place of PU leather, and another variant:

PU leather-adhesive-bonded leather-adhesive-cork-adhesive-PU leather.

Here, the PU foam or cork are only used for heat protection. The other layers support this, but also fulfill other important properties of flexibility and stability for the product.

The following thermal conductivity values have been identified for given materials:

| | |
|---|---|
| PU foam | 0.04 W/mK |
| cork | 0.045 to 0.06 W/mK |
| PE foam | 0.035 W/mK |

For PU leather and bonded leather no thermal conductivity value is known. In long-term tests good values were achieved here. The use of PE-foam proved to be advantageous because it is capable of withstanding the long-term influence of heat of 60° C., and the mechanical stress was fulfilled.

Also a variant is given where the bonded leather is already applied on the PU leather layer and can be used as a cover layer.

A further possible application is the use of poly-epoxy resin layers, polymeric films, etc., which are mounted inside and outside. In this process, there is the problem that the hinge 4 must be accommodated in the coating. Since it does not have the surface of the sleeve 1 and may not have it, otherwise a bending of the outer faces would be impossible, it cannot receive a separate layer, but must be embedded in another layer. Here a possible cork layer is being used. It will receive cut-outs—see FIG. 4—in comparison to the bonded leather where the hinge 4 is embedded. Since the hinges 4 with its hinge faces are rigid and thus do not cling directly to the hot drink, there is no need for additional insulation here. When selecting another layer, it is to be considered that the hinge 4, if it is closer to the cup and container 10, can also absorb and transport more heat. If you fold the hinge 4 together, so that the suspending faces of the sleeve 1 are parallel, only a maximum clearance of 2 mm exists.

Another option would be to create a mold on the inside of one side of the sleeve 1 and embedding it there. However, the hinge metal faces are 0.9 to 1.2 mm thick, and the bonded leather layers also, if not smaller.

In the selection of the hinges 4 there are various possibilities. First, there are metal hinges in a given adapted form. It is therefore possible, to use various shapes and designs of the hinges 4. Also, various colors of the hinges 4 are possible. There are also hinges 4 made of other materials than metal. In particular, the material of polymers has to be considered.

Another way of treating the hinges 4 is given by coating the hinges 4 with a material layer, and attaching these then with rivets 6, 6.1, 6.2, and 6.3 on the side faces of the sleeve 1. The hinges 4 are not glued in the outer faces of the sleeve 1 but firmly fixed therein with rivets 6, 6.1, 6.2, and 6.3 and/or eyelets. In particular hollow rivets are used. But also, other forms of rivets or decorative rivets can be used. Here, a bonding of the hinges 4 and the outer edge respectively is possible.

You can manufacture the sleeve 1 also in a way so that the rivets 6, 6.1, 6.2, and 6.3 are no longer visible from the outside, when a so-called optical shutter is installed over the entire outer surface of the respective side of the sleeve 1. This outer surface can also be used as a promotional item or for identifying the product or personal identification.

Furthermore, corresponding eyelets for hanging the sleeve 1 on and up can be given. These eyelets can be incorporated in the riveting process.

Another embodiment is in that realizable that the sleeve 1 when setting the cup and container 10 down does not slip from the cup and container 10. Here, a corresponding profile is incorporated in the inner surface of the sides of the sleeve 1 in a way that the slipping of the sleeve 1 when setting down the cup and container 10 is not taking place. This embossment additionally supports the adhesion. Furthermore, the surface, which has direct contact with the cup, is reduced in this way. Thus, less heat or cold is transported and reaches a better protection of the hands and a preservation of the temperature of the drink.

Figure 2:
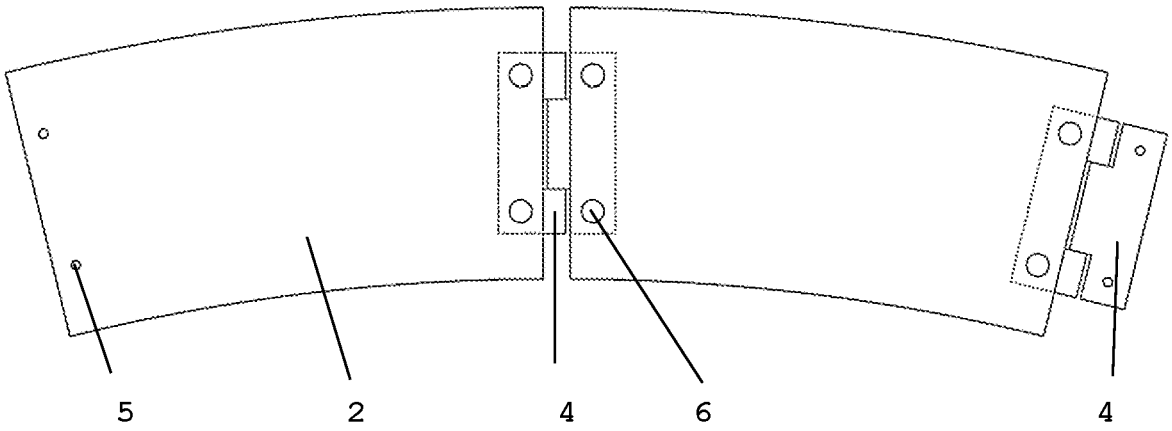
FIG. 2 is a front plane view of the sleeve in a completely unfolded state.
Figure 3:
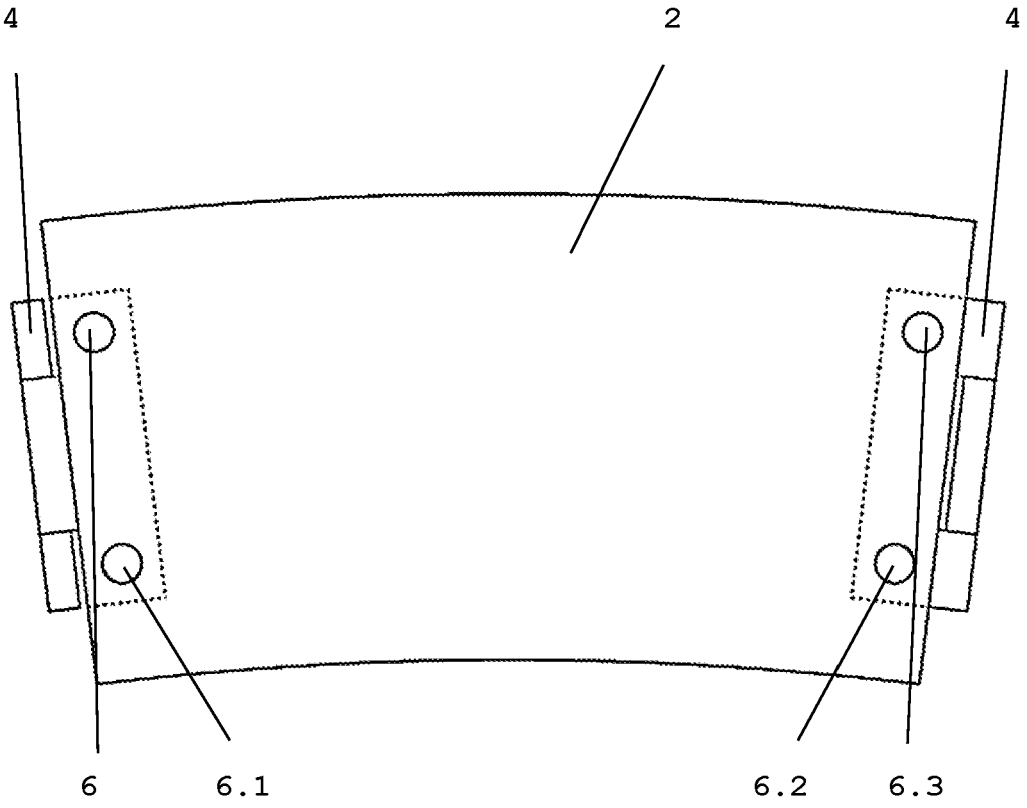
FIG. 3 is a front plane view of the sleeve outer face with hinges.
Figure 4:
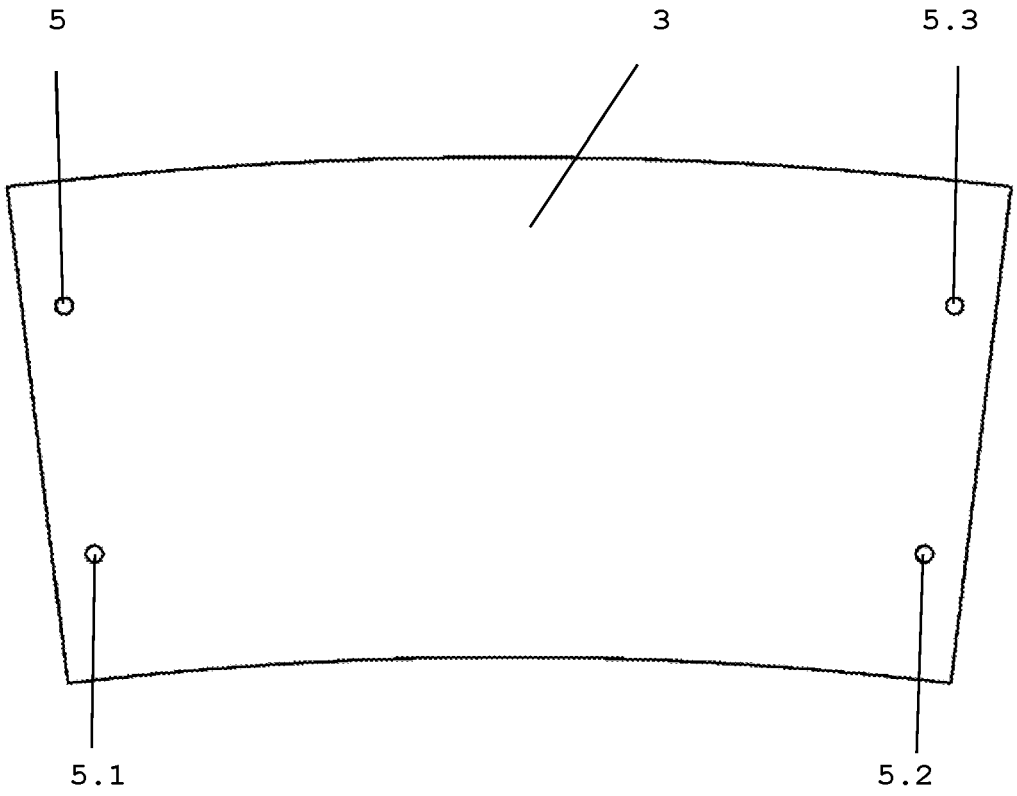
FIG. 4 is a front plane view of the sleeve outer face without hinges with holes.
Figure 5:
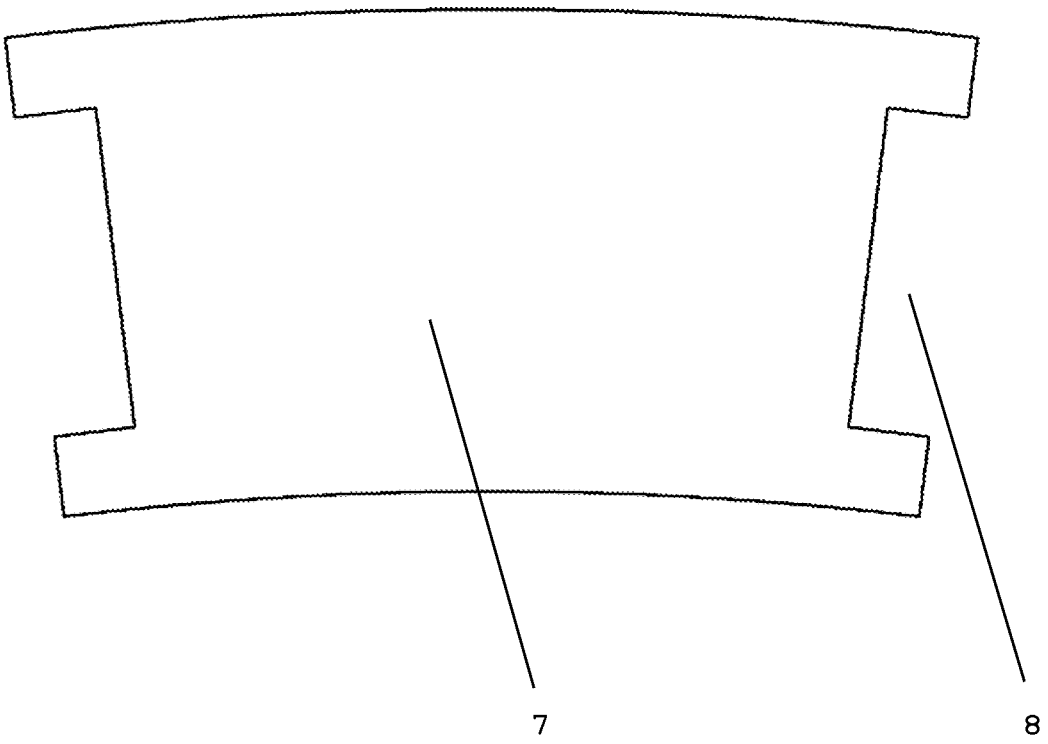
FIG. 5 is a front plane view of the sleeve inner layer with cut-outs.

Particularly in FIGS. 2 and 3 and in conjunction with FIG. 4 it can be seen that at the outer edges of the respective sleeve sides of the sleeve 1 a per se known hinge 4 is allocated.

In FIG. 3 it can be seen that a sleeve side of the sleeve 1 on the right and left outer edge are firmly connected with a hinge 4 through rivets 6, 6.1, 6.2, and 6. These hinges 4 of the side of the sleeve 1 are then firmly connected with the other side of the sleeve 1 with the sleeve part 3 through the holes for rivets 5, 5.1, 5.2, and 5.3 with rivets 6, 6.1, 6.2, and 6.3. The two hinges existing right and left 4 at the outer edge of the sleeve 1 now serve for folding and unfolding the sleeve 1, as visible in FIG. 1, and placing it on a cup and container 10 from below. When the cup and container 10 is taken out from the sleeve 1, it folds the sleeve 1 into itself, and produces only one sleeve 1 in a folded, planar state.

From FIG. 3 it is visible, how the sleeve unfolded 2 is given in an unfolded state with the help of the hinges 4. Here the functional configuration of the sleeve 1 is clearly visible that through the outer edges with the hinges 4 and a fixed connection through rivets 6, 6.1, 6.2, and 6.3 and holes 5, 5.1, 5.2, and 5.3 a flexible sleeve 1 for cups and containers 10 to place on from below, exists.

Through the arrangement of the two hinges 4 and the flexibility of the layered materials the sleeve 1 can be bend in a conical shape which adapts to paper cups and containers 10. The incorporated layers serve in its rigidity when in the use in order to have adhesion on the cups and containers 10. When the sleeve 1 is not used, it supports the return to the idle state, a parallel state of the faces of the sleeve 1. An integrated embossment on the inner surfaces enhances the adhesion of the sleeve 1 on a corresponding cup and container wall 10. The user can decide on the individual components of a sleeve 1, the shape and color interactively as well as let engravings and patterns be incorporated. Also, the rivets are variable, for example, rivets with logo or rhinestone rivets.

Furthermore, the inner rivets can be countersunk into the inner leather fiber material layer with a larger cut-out in size of the head, whereby again the contact is reduced.

Figure 6:
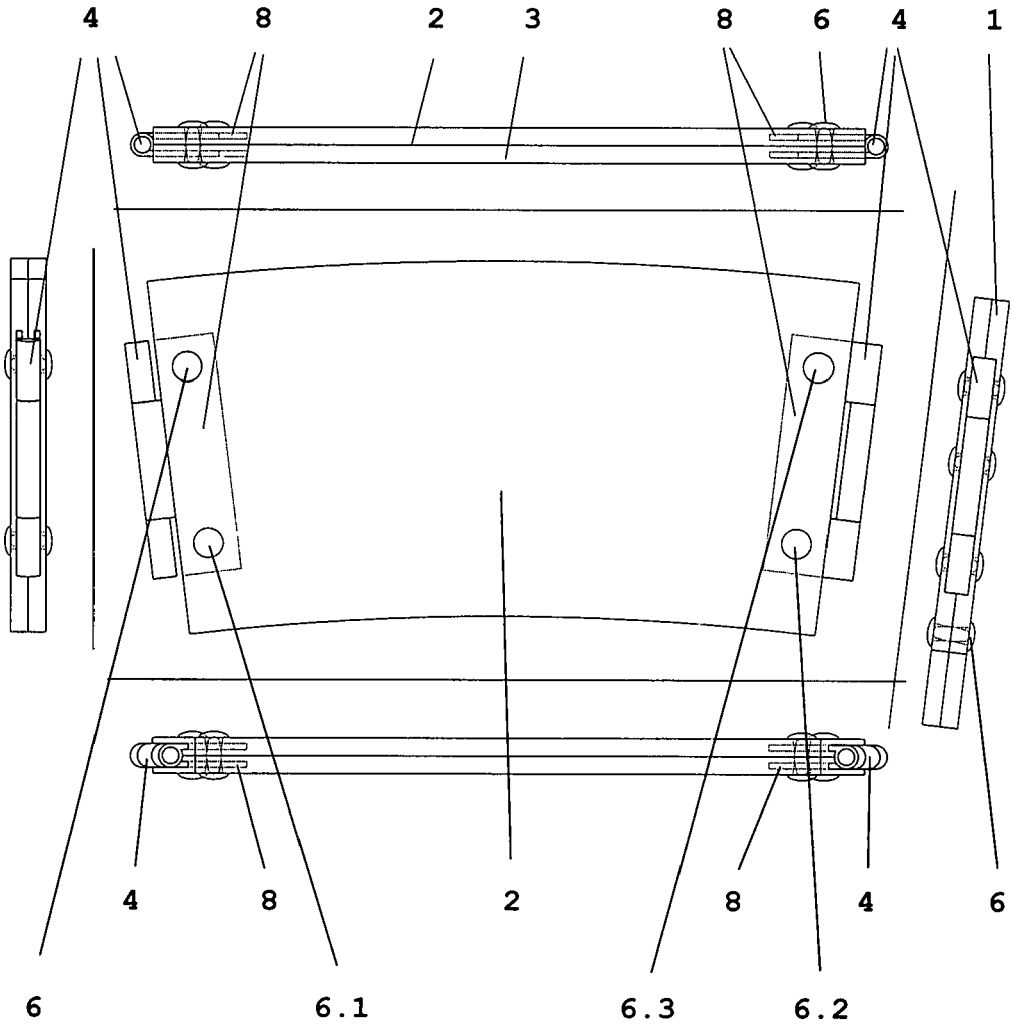
FIG. 6 is a front, left, right, top and bottom plane view of placement of the hinges.

In FIG. 6 the embedding of the hinges 4 in the sleeve 1 in the individual sleeve unfolded 2 and the sleeve part 3 is visible. Here, cut-outs 8 in the intermediate layers of the sleeve unfolded 2 and the sleeve part 3 are given. In these cut-outs 8 for hinge 4 each hinge leaf is inserted and the rivets 6, 6.1, 6.2, 6.3 firmly locked. In the above representation of FIG. 6 the cut-outs 8 for the hinge leaves of the hinge 4 in the intermediate layer at the respective outer edges of the sleeve—unfolded 2 and the sleeve part 3 are visible. So, it is worth mentioning no bonding process takes place, but that only through the intermediate layer on the outer edges of the respective sleeve parts the hinge leaves and rivets 6, 6.1, 6.2, 6.3 are locked firmly.

Figure 7:
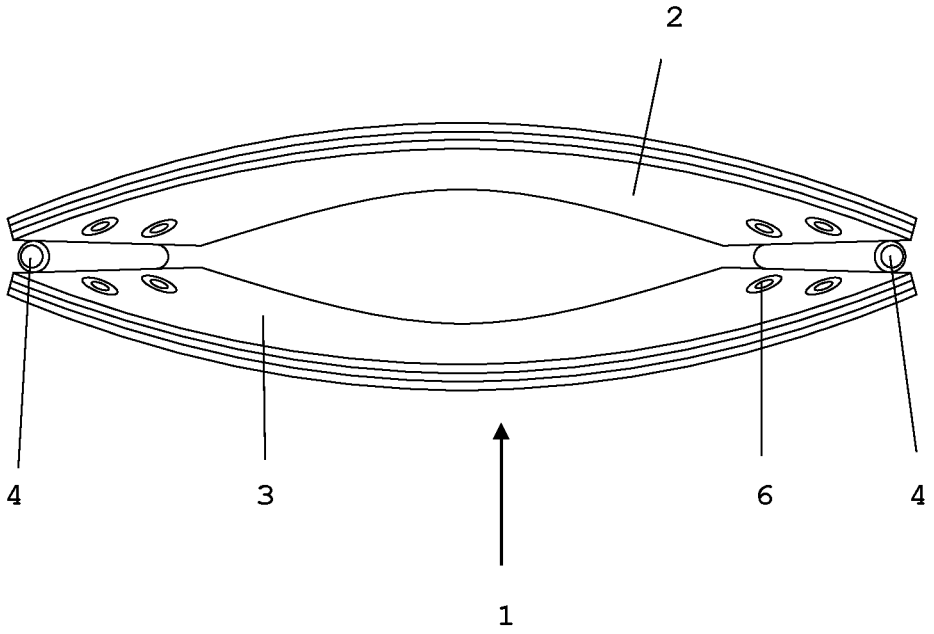
FIG. 7 is a top perspective view of the sleeve.

FIG. 7 shows a plan view of the sleeve 1 in a slightly opened state. Here the hinges 4 left and right of the outer edges of the sleeve unfolded 2 and the sleeve part 3 of the sleeve 1 are given. Also, the conical shape of the sleeve 1 can be recognized.

The advantage of the inventive solution is based on the fact that a constant reuse of the sleeve 1 for use even for cups and containers 10 is possible. The application of a varnish layer on the sleeve 1 adds a noble quality optic. Here, the varnish layer with a leather fiber material layer is reinforced, so that the incorporation of an engraving on the outer surface is possible.

A sleeve 1 according to the invention is described again below. The sleeve 1 consists in its composition of seven layers and a surface coating which combines to a total thickness of approximately 2 to 3 mm. Since the sleeve 1 has two sides, it results in a total thickness of about 4 to 6 mm.

The structure is described below:

Varnish layer
Bonded leather layer
Bonding agent
Cork layer
Bonding agent
Bonded leather layer
Varnish layer The functionality of the individual layers is shown below.

The surface coating of varnish is used for protection and easier cleaning.

The outer varnish layer gives the sleeve 1 its high-quality optics and is used for the choice of color. When incorporating an engraving this is removed and possibly replaced with paint of another color.

The bonded leather layer is used for returning into a planar state and the incorporation of an engraving, and insulation.

The middle bonding agent is used to connect the bonded leather layer with the cork layer.

The cork layer is used exclusively for thermal insulation.

The inner bonding agent is used to connect the cork layer to the inner bonded leather layer.

The inner bonded leather layer is used to return to a planar state and the incorporation of a profile for better adhesion on the cup and container 10 and the insulation.

The inner varnish layer gives the sleeve 1 a high-quality optic.

The surface coating of varnish is used for protection and easier cleaning.

LIST OF REFERENCE NUMBERS

1 sleeve
2 sleeve unfolded
3 sleeve part
4 hinge
5 hole for rivets
5.1 hole for rivets
5.2 hole for rivets
5.3 hole for rivets
6 rivets
6.1 rivets
6.2 rivets
6.3 rivets
7 sleeve with cut-outs
8 cut-outs for hinge 4
10 cups and containers

The invention claimed is:

1. A sleeve for holding and carrying different sized cups or containers, the holder comprising:

a first sleeve part including a first hinge part located on a first lateral edge thereof, and a second hinge part located on a second lateral edge thereof opposite the first lateral edge; and a second sleeve part including a first hinge part located on a first lateral edge thereof, and a second hinge part located on a second lateral edge thereof opposite the first lateral edge;

wherein the first hinge part of the first sleeve part is operably engaged with the second hinge part of the second sleeve part, and the second hinge part of the first sleeve part is operably engaged with the first hinge part of the second sleeve part, so as to form an assembled conical sleeve for receiving a cup or container from therebelow when pressure is applied to the first and second lateral edges of the first and second sleeve parts;

wherein the first and sleeve parts being made of various layered material combinations configured to create tension through the layered material combinations to collapse the assembled conical sleeve, the layered material combinations include a first layer, an intermediate layer, and a second layer, with the first and second layers being on opposite sides of the intermediate layer;

wherein first and second lateral edges of the intermediate layer of each of the first and second sleeve parts define a cut-out open to an exterior of the first and second lateral edges of the intermediate layer, respectively, the cutout being configured to receive a part of the first and second hinge parts, respectively, so that the part of the first and second hinge parts received in the cut-out is adjacently between the first and second layers, respectively, and wherein the first and second layers extend over the part of the first and second hinge parts received in the cut-out, respectively.

2. The sleeve according to claim 1, wherein the first layer is a first bonded leather layer, the intermediate layer is a cork layer, the second layer is a second bonded leather layer.

3. The sleeve according to claim 2, further comprising a varnish layer applied to an exterior of the first and second bonded leather layers.

4. The sleeve according to claim 2, further comprising a polyurethane (PU) leather layer bonded to the first bonded leather layer.

5. The sleeve according to claim 1, wherein the first layer is a PU leather layer bonded to a leather layer, the intermediate layer is a PU foam, the second layer is a PU leather layer.

6. The sleeve according to claim 1, wherein the first and second hinge parts of the first and second sleeve parts are connected to the first and second lateral edges, respectively, by way of rivets.

7. The sleeve according to claim 1, wherein the part of the first and second hinge parts of the first and second sleeve parts is riveted to the first and second layers, respectively, by rivets.

8. The sleeve according to claim 7, wherein the first and second layers of the first and second sleeve parts define countersunk cut-outs for receiving a head of the rivets, respectively.

9. The sleeve according to claim 1, wherein the first layer is bonded by an adhesive to a first side of the intermediate layer over a whole surface thereof, and the second layer is bonded by an adhesive to a second side of the intermediate layer over a whole surface thereof.

10. The sleeve according to claim 1, wherein the first and second sleeve parts each include a first and second longitudinal edges being curved when the first and second sleeve parts are in a flat state.

11. The sleeve according to claim 10, wherein the first and second lateral edges of the first and second sleeve parts are angled toward each other when in the flat state.

12. A sleeve for holding and carrying different sized cups or containers, the holder comprising:

a first hinge and a second hinge each including a first part and a second part;

a first sleeve part including a first layer, an intermediate layer, and a second layer, the intermediate layer including first and second lateral edges each defining a cut-out open to an exterior of the intermediate layer, one of the cut-outs being configured to receive the first part of the first hinge and the other of the cut-outs being configured to receive the first part of the second hinge; and a second sleeve part a first layer, an intermediate layer, and a second layer, the intermediate layer of the second sleeve part including first and second lateral edges each defining a cut-out, one of the cut-outs of the second sleeve part being configured to receive the second part of the first hinge and the other of the cut-outs of the second sleeve part being configured to receive the second part of second hinge;

wherein the first and second sleeve parts are assembled by way of the first and second hinges forming an assembled conical sleeve for receiving a cup or container from therebelow when pressure is applied to the first and second lateral edges of the first and second sleeve parts;

wherein the first and second layers of the first and second sleeve parts extend over the first part and the second part of the first and second hinge parts received in the cut-out, respectively;

wherein the first layer, the intermediate layer, and the second layer of the first and sleeve parts being made of various material combinations configured to create tension to collapse the assembled conical sleeve.

13. The sleeve according to claim 12, wherein the first layer is a first bonded leather layer, the intermediate layer is a cork layer, the second layer is a second bonded leather layer.

14. The sleeve according to claim 13, further comprising a varnish layer applied to an exterior of the first and second bonded leather layers.

15. The sleeve according to claim 13, further comprising a polyurethane (PU) leather layer bonded to the first leather layer.

16. The sleeve according to claim 12, wherein the first layer is a PU leather layer bonded to a leather layer, the intermediate layer is a PU foam, the second layer is a PU leather layer.

17. The sleeve according to claim 12, wherein the first part and the second part of the first and second hinges are riveted to the first and second layers of the first and second sleeve parts, respectively, by rivets.

18. The sleeve according to claim 12, wherein the first and second sleeve parts each include a first and second longitudinal edges being curved when the first and second sleeve parts are in a flat state.

19. The sleeve according to claim 18, wherein the first and second lateral edges of the first and second sleeve parts are angled toward each other when in the flat state.

* * * * *